US005626432A

United States Patent [19]

Swift et al.

[11] Patent Number: 5,626,432

[45] Date of Patent: May 6, 1997

[54] ADJUSTABLE LOCKING BINDER

[76] Inventors: Daniel P. Swift, 1918 Curtis, Laramie, Wyo. 82070; Thomas R. La Croix, 244 E. Fallen Rock, Grand Junction, Colo. 81503; William E. Bullock, P.O. Box 1328, Glenwood Springs, Colo. 81602

[21] Appl. No.: 600,453

[22] Filed: Feb. 13, 1996

[51] Int. Cl.[6] ..... B42F 3/00

[52] U.S. Cl. ..... 402/8; 402/13; 402/15; 402/63; 402/60

[58] Field of Search ..... 402/8, 63, 15, 402/60, 13, 14, 68, 64; 281/15.1, 21.1

[56] References Cited

U.S. PATENT DOCUMENTS

| | | | |
|---|---|---|---|
| 3,898,717 | 8/1975 | Schwartz | 24/259 |
| 4,174,909 | 11/1979 | Jahn | 402/13 |
| 4,174,910 | 11/1979 | McSherry et al. | 402/19 |
| 4,294,469 | 10/1981 | Errichello | 281/29 |
| 4,304,499 | 12/1981 | Purcocks | 402/63 |
| 4,453,851 | 6/1984 | Purcocks | 402/15 |
| 5,257,870 | 11/1993 | Bennett et al. | 402/63 |
| 5,265,968 | 11/1993 | Atkins | 402/63 |
| 5,405,209 | 4/1995 | Johns et al. | 402/28 |

*Primary Examiner*—Willmon Fridie, Jr.

[57] ABSTRACT

An improved sheet binding device for fastening together a plurality of sheets having prepunched, spaced apart openings, comprises a plurality of locking members for each pre-punched hole, either with an individual restraining element or connected with a backing member extending between them, each comprising a connecting portion for insertion through the openings and a series of interlocking elements or teeth extending along the length of the locking member and a receiving member with an opening to receive the length of the locking member and a series of compatible interlocking elements or teeth, shaped to receive the interlocking elements of the locking member, so that when the locking element is in the (1) locked position, the interlocking elements or teeth are engaged and immovable relative to each other and when the locking element is in the (2) unlocked position, the interlocking elements or teeth are disengaged to allow removal of the receiving element and insertion of sheets of paper. The interlocking elements of the locking member may engage the interlocking elements of the receiving member at any position along the length of each, allowing the device to automatically bind any thickness of paper within a certain range without manually changing settings, and locking members of different lengths may be substituted to accommodate extreme thicknesses of paper sheets. This structure may be integrally cast from plastic material.

8 Claims, 4 Drawing Sheets

ADJUSTABLE LOCKING BINDER

BACKGROUND OF THE INVENTION

1. Field of the Invention

This invention relates to an improved paper binder and in particular to an adjustable interlocking binder that can be adjusted to hold any plurality of sheets of paper, but that can be locked tightly so that the sheets are not loosely bound as with a ring binder. The components of the adjustable locking binder are preferably molded of plastic material, are interchangeable, can be provided for two or more holes in prepunched sheets, and can be readily unlocked to add more sheets of paper. Further, the shape of the locking strap is such that it will allow threading of the paper sheet onto the element without prepunching. The binder locks by means of interlocking elements or teeth in both components of the binder.

2. Description of the Prior Art

One of the most common paper binding methods in use today is a two part metal binder. The binder includes a front and back cover perforated with standard spaced holes through which a thin narrow metal insert is passed and on which, prepunched paper sheets are placed. After the cover is placed, a grooved metal front portion, with holes at extreme ends to receive the ends of the insert is added after which the metal insert ends are bent over into the groove to confine the layers. Sliding locking members, affixed to the metal front are the slid over the bent metal insert ends to hold them in place.

The obvious advantage of this method is that the binder can be repeatedly undone to add more sheets of paper, but the thickness of the folder is only that needed to contain the papers, unlike a conventional ring binder. The art likewise exhibits some distinct disadvantages. Constant use and reuse of the metal type components can cause failure through metal fatigue in the bent parts, and the sharp edges of the metal inserts cuts the bound paper causing sheets to come loose to be lost or misplaced. Constant bending of the metal inserts causes them to deform and makes it difficult to reinsert the ends through the grooved front piece. The metal components can also cut the user and commonly the sliding tabs become loose or sloppy through use and so can slide off the metal insert, allowing the folder to come apart. An additional disadvantage of the metal binder is that it requires more energy to manufacture and assemble than a comparable plastic product.

Some attempts have been made to address the disadvantages of this prior art, most notably U.S. Pat. No. 4,174,910 to McSherry et. al. The patent discloses a plurality of binding clips with a collapsed and expanded position, so that after a paper sheet is placed over the collapsed clip, it is pressed down, locking the sheet in place. The disadvantages of this are manifold. Firstly, the paper depth allowed by the clip is very limited. The invention provides for adjustable paper depths by means of additional adjustable elements, but this requires a conscious and constant effort on the part of the user, making the binder too inconvenient for constant use. Secondly, an even greater disadvantage is that when the binder elements are collapsed onto an excessive thickness of papers, the papers exert an upward pressure on the clips, so that any force put on the clips will cause them to collapse and release the papers.

Another type of binder in common usage consists of plastic strips with connecting plastic stems that are inserted through prepunched holes in the paper sheets. The strips are pressed together, engaging the connecting stems, clamping the sheets, and locking the strips tightly together. The disadvantages of this method is that the strips cannot be disconnected and reconnected to add more sheets of paper and they are limited in the number range of sheets of paper that can be bound. Still another type of plastic binder consists of a plastic sheet folded to enclose a plurality of sheets of paper and a plastic U shaped strip that slides over the folded edge of the plastic cover sheet. There are several disadvantages to this method. First, the number of sheets that can be bound is limited, and second, because the sheets of paper are held together by pressure exerted by the U shaped strip, when the strip deforms over time, it losses clamping pressure and lets the sheets fall loose.

The disadvantages of rigid ring binders are self evident when compared to the current invention. A rigid ring binder has a fixed thickness regardless of the number of sheets of paper bound, which causes the binder to occupy excessive shelf and file space. Also, ring binders are relative expensive to produce in terms of energy and mechanism complexity.

SUMMARY OF THE INVENTION

Accordingly, the object of the present invention is to address and correct as many disadvantages of the currently produced binders as possible.

This present invention teaches improvements in binding devices for fastening together a plurality of sheets preferable having prepunched, spaced-apart openings. The invention comprises a elongated member with a restraining element at one end and a series of interlocking teeth along it's length terminating in a second tapered end which includes a lift up tab and a small locking nipple or protrusion. The elongated member is inserted through prepunched holes in a stack of cover and paper sheet material from the bottom of the stack. The end restraining element or plate on the elongated member prevents the elongated member from being drawn through the prepunched holes and a receiving or confining member containing two grooves, the bottom of which has a series of compatible interlocking teeth to receive the teeth of the elongated member is placed over the top of the paper stack and protruding ends of the elongated member. A hole in the extreme ends of the receiving member allow the ends of the toothed elongated member to pass through, after which the elongated member it is bent over and interlocked to the receiving member by virtue of the teeth of both parts. A slot in the grooves of the receiving member receives the locking nipple of the elongated member thus locking the end of the elongated member in place. The interlocking teeth of the two components are shaped so that force exerted by the bound paper sheets cause the components to lock tighter together so that the more force that is exerted the tighter the bundle is held together. Further, the shape of the interlocking teeth allow the two components to be separated by pulling up on the end tab and elongated member. The two or more elongated members or locking strands are identical and the top receiving member has no moving parts so that the components may be economically cast of plastic or other suitable material.

A unique feature of the present invention is that the elongated strands can be locked in any location along the length of the grooves in the receiving member thus any thickness of paper stack may be bound.

Accordingly, besides the objects and advantages of providing a binding method with interlocking teeth described above, several other objects and advantages of the present invention is to provide a binder that will automatically adjust to any thickness of paper stack and lock without special effort by the user.

Another object of the present invention is to provide a binder with interlocking teeth that can be used to bind paper sheets along any edge and through any number of holes, preferably standard two and three hole patterns.

Still another object of the present invention is to provide a binder with interlocking teeth that is easily disassembled and reassembled to add additional sheets of paper.

Yet a further object of the present invention is to provide a binder with interlocking teeth that has interchangeable locking elements that allow various thicknesses of paper stacks to be bound, so that a range of stack thicknesses may be accommodated with a particular element length, and other thicknesses accommodated by replacement elements.

Yet a further object of the present invention is to provide a binder with interlocking teeth that can be economically produced or cast from plastic materials and so has no sharp edges or corners to cut the bound paper or appendages of the user.

Yet a further object of the present invention is to provide a binder with interlocking teeth that can be repeatedly assembled and disassembled without permanent deformation of the components or failure of the locking members due to material fatigue.

Yet a further object of the present invention is to provide a binder with interlocking teeth that can be produced in a variety of colors so that binder color can be used as an aid in filing or organizing.

Yet a further object of the present invention is to provide a binder with interlocking teeth that nonpunched sheets of paper can be added to by pushing the sheets over a piercing point on the binder locking strand onto the paper stack.

Yet a further object of the present invention is to provide interlocking teeth that keep the elements locked together when in place, and when force from the bound paper is exerted on the elements the interlocking teeth are caused to engage more tightly.

Yet a further object of present invention is to provide a binder with interlocking teeth so that the increment of adjustability can be changed by producing the components with different teeth sizes or proportions.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art,

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE PREFERRED EMBODIMENTS

Figure 1:
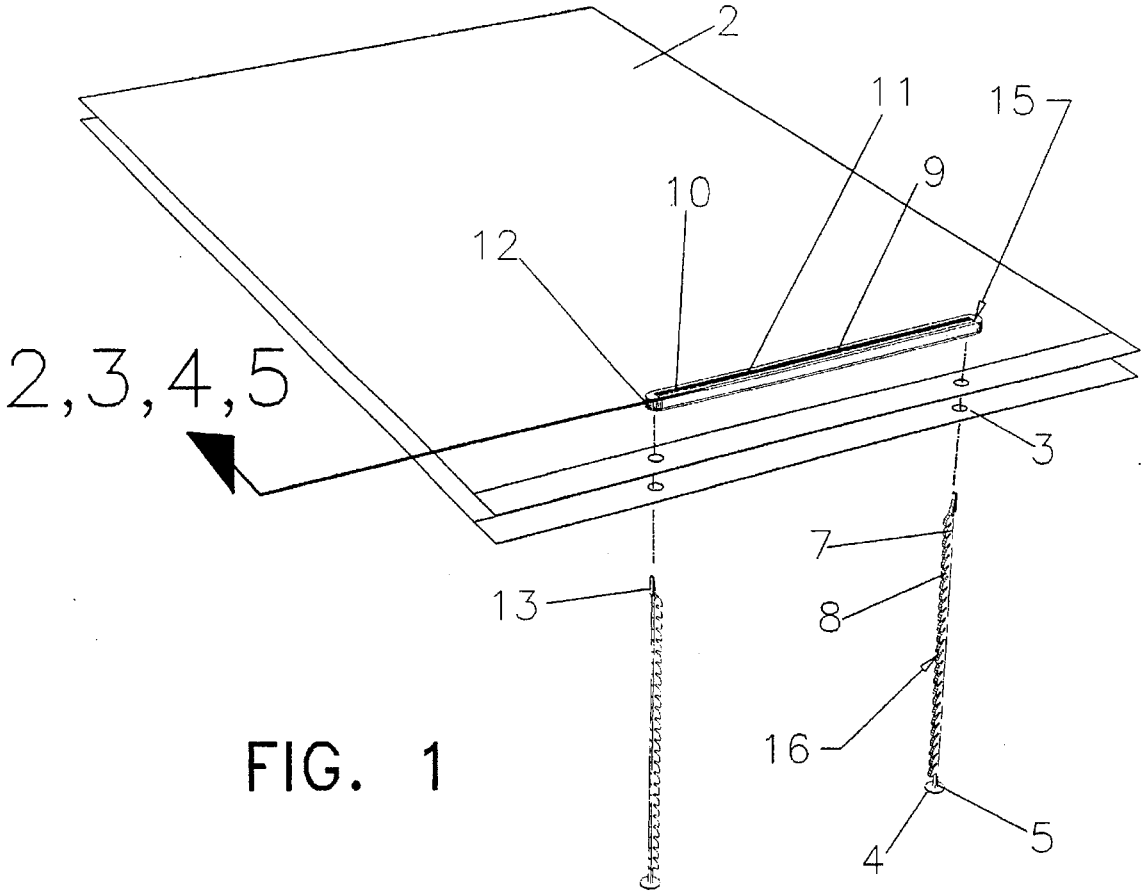
FIG. 1 is an exploded perspective view of a two hole cover with locking strands and top receiver.

A typical application of the present invention is shown in FIG. 1. A standard two hole cover with top and bottom generally indicated as 2 contain prepunched holes 3 at standard spacing. A locking strand assembly 16 contains a restraining button or plate to prevent the strand from being pulled through prepunched holes 3. A transition stem 5 is connected to plate 4 and interlocking teeth 7 and base strip 8 which continue along the length of strand 16. A lifting tab 13 is connected at the end of the locking strand 16. The tab is of thin profile so that it may easily be lifted to release the strand after it is in place and to allow paper sheets to be pressed over the strand in the event the sheet is not prepunched with holes. The locking strands 16 pass through holes 3 and through holes in the ends of the top receiver assembly 15 where they are pressed into groove 11, to engage compatible teeth 9 and lock into slot 10. An end block 12 provides a finished end to the assembly 15.

Figure 2:
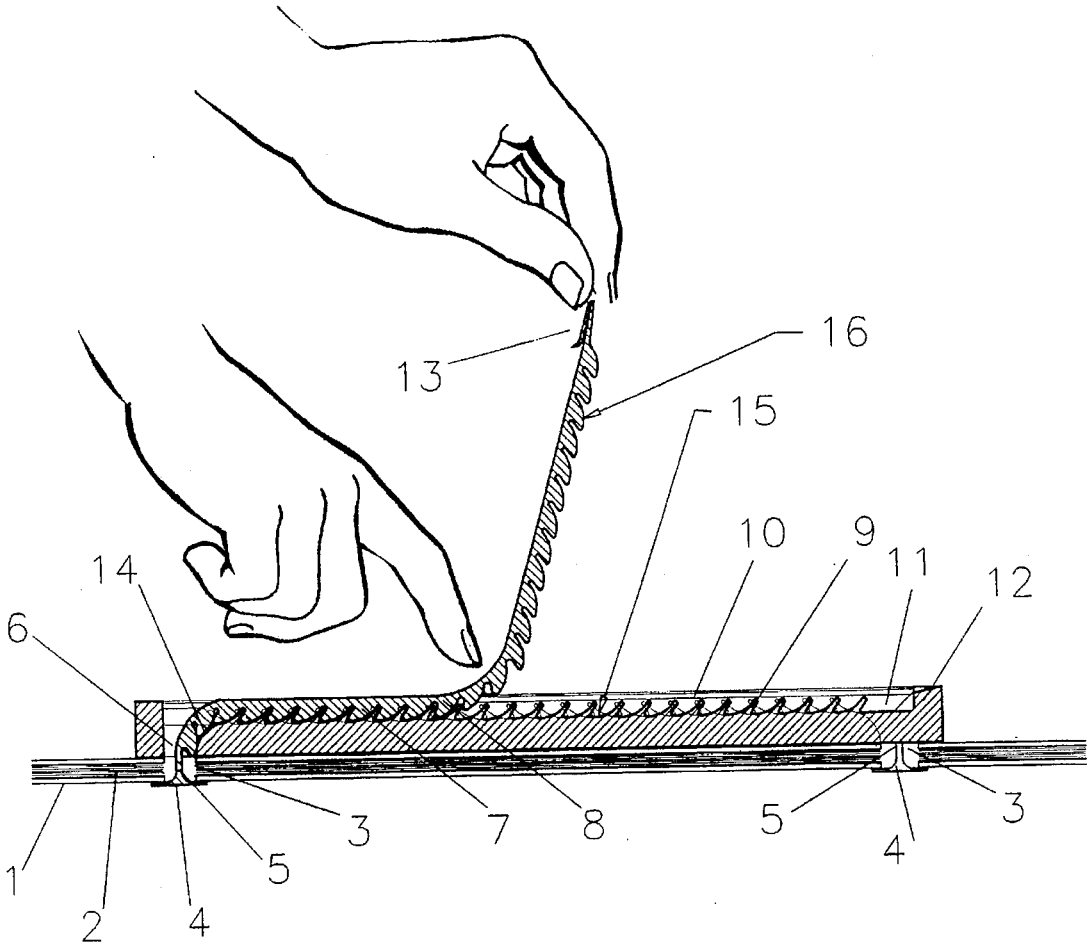
FIG. 2 is a section cut according to FIG. 1, showing the locking strand being pushed into place into the top receiver.
Figure 3:
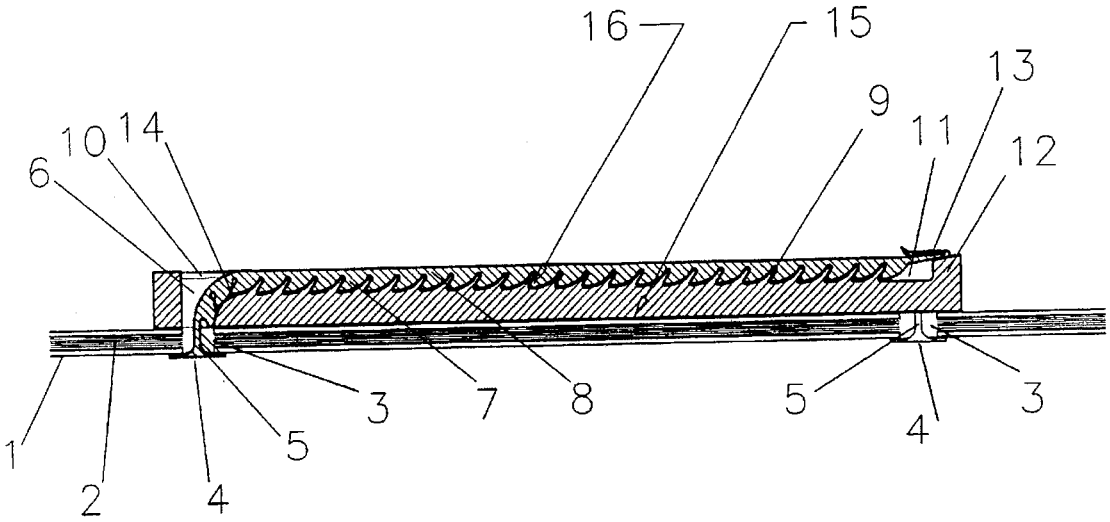
FIG. 3 is a section cut according to FIG. 1 showing the locking strand in place in the top receiver.
Figure 4:
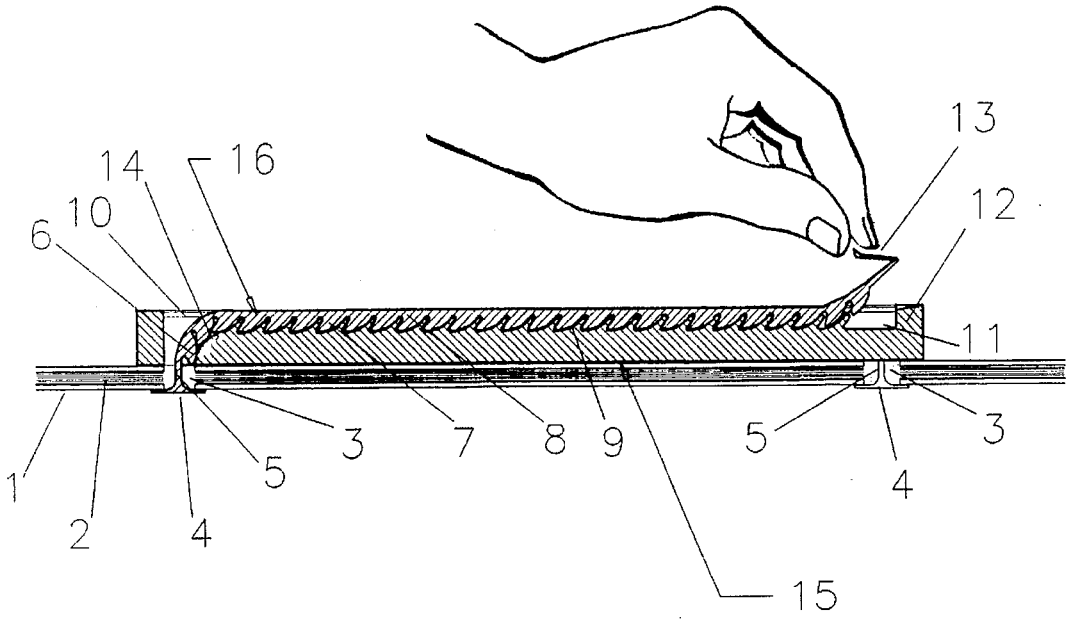
FIG. 4 is a section cut according to FIG. 1 showing the locking strand being released by pulling up on the release tab.
Figure 5:
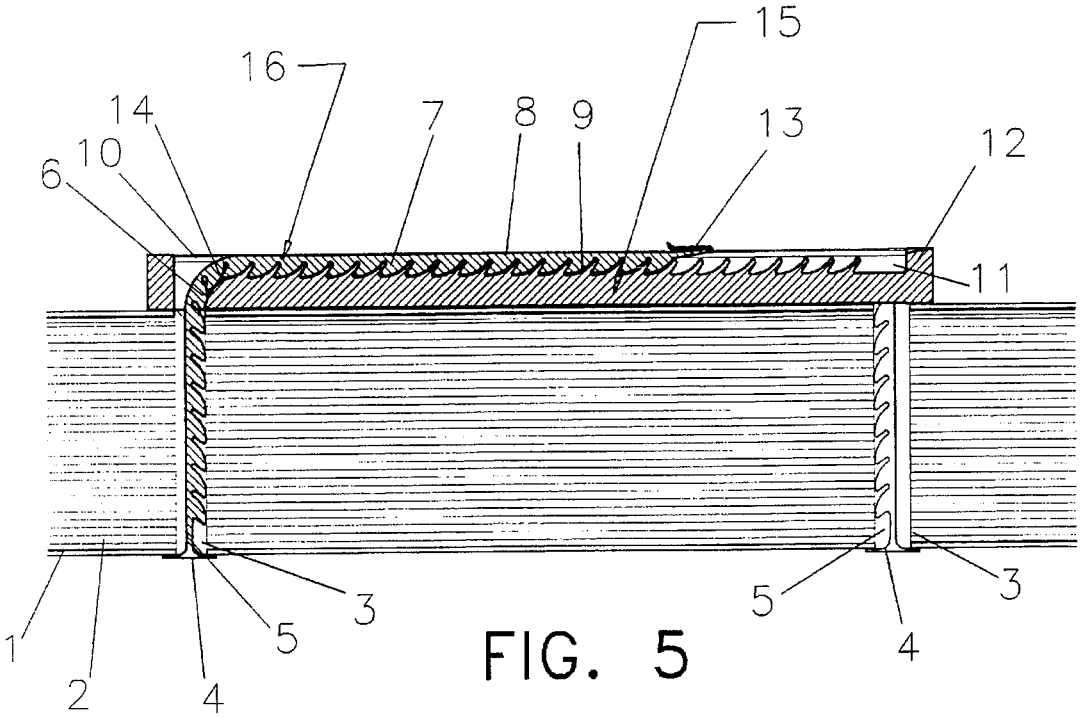
FIG. 5 is a section cut according to FIG. 1 showing a thickness of paper sheets and the adjustability of the locking strand.
Figure 8:
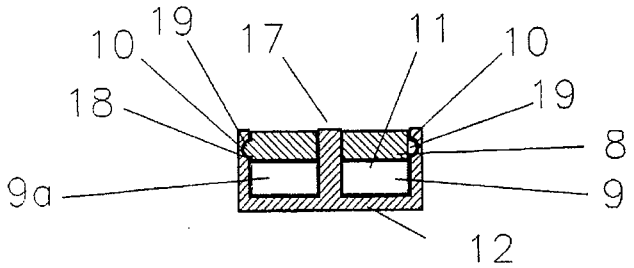
FIG. 8 is a section view according to FIG. 7 showing the locking strands in place in the top receiver.
Figure 9:
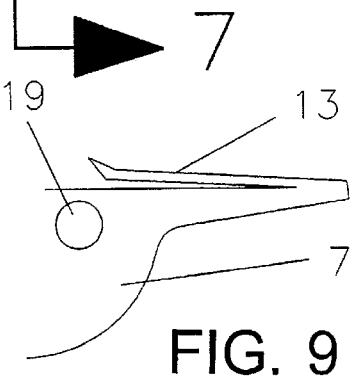
FIG. 9 is a side view of the locking strand end.

FIG. 2 is a sectional view illustrating how the locking strand 16 is interlocked to the top receiver assembly 15. The strand assembly 16 is inserted from the bottom of the covers 1 and paper sheets 2, through prepunched hole, 3 and into receiver hole 6. The paper sheets can be locked tightly together by simultaneously pulling up on the locking strand and pushing down on the top receiver. The locking strand 16 is then pushed over transition radius 14 in the top receiver groove 11. While holding the end of the strand up with one hand and pushing down and sliding a finger or object along the strand length, the strand interlocking teeth 7 are caused to rotate and engage top receiver interlocking teeth 9. It can be seen in the illustration that by bending the strand in a shallow to steep angle that the teeth 7 are caused to rotate sufficiently to disengage or engage the teeth 9 of the top receiver. Further more, once the locking strand teeth have engaged the top receiver teeth 9, the shapes of the two teeth hold the locking strand in place in the top receiver groove 11 and will not allow it to move horizontally or vertically relative to the top receiver. Additionally, pressure exerted on the strand plate 4 by the bound paper sheets causes the teeth 7 and 9, by virtue of their shape, to be more tightly locked together. Pressures placed on the strand by the bound paper are resisted by shear forces in the bases of teeth 7 and 9 and tensile forces in strand base strip 8. Referring also to FIG. 8 and 9 it can be seen that continuous slot 10 in the side of groove 11 receives a locking button or nipple 19 on the side of the locking strand at the end near the release tab 13 so that the strand will not accidentally be pulled and released from the top receiver. FIG. 3 is a similar sectional view showing the locking strand fully engaged in the top receiver groove 11. Referring to FIG. 4, FIG. 8, and FIG. 9 it can be seen how the locking strand 16 is removed from the top receiver 15. Release tab 13 is lifted upward so that it may be grasped by the fingers. Pulling up further causes the locking nipple to be pulled from slot 10, by causing side wall 18 to slightly deflect outward, releasing the locking strand. By pulling the strand upward and slightly backward, the strand teeth 7 are caused to rotate away from the top receiver teeth 9 and so disengage the strand from the top receiver. FIG. 5 is a sectional view showing how the locking strand and top receiver allow addition of paper sheets. As described above, the strands 16 are disengaged from the top receiver, the top receiver and cover removed, additional sheets of paper added, the cover and top receiver replaced over the locking strands 16, through receiver hole 6 and strands 16 are reengaged into the top receiver as described above. The locking strand automatically adjusts to the paper depth by sliding down the receiver groove 11 an equal distance. The paper is held in place as long as a certain minimum number of interlocking teeth 7, 9 are available to engage each other. Locking strands of varying length are readily substituted to accommodate additional layers of paper sheets.

Figure 6:
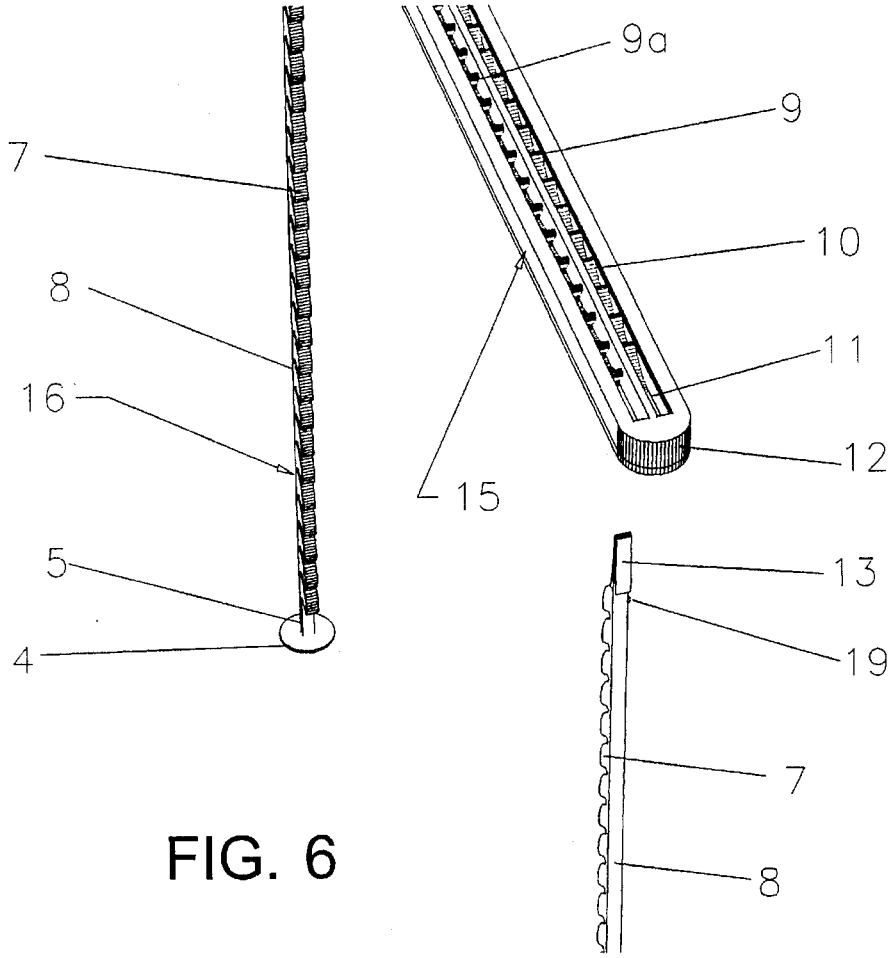
FIG. 6 is an exploded perspective view of the locking strands and top receiver.
Figure 7:
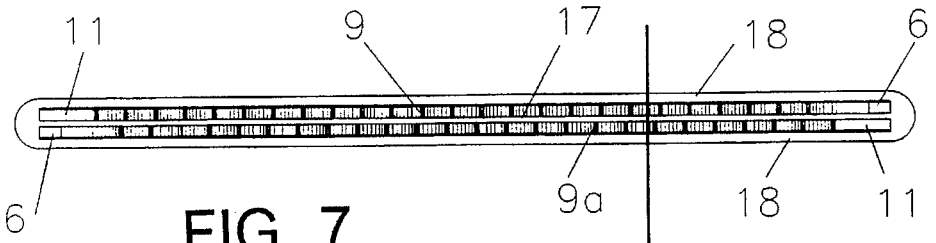
FIG. 7 is a top view of the top receiver.

FIG. 6 is a partial perspective view showing the top receiver assembly 15 and locking strand assemblies 16. Top receiver interlocking teeth 9 are shown in receiver groove 11. A mirror imaged set of receiver interlocking teeth 9*a* are shown in an adjacent groove 11. Referring also to FIG. 7, a top view of the receiver, the interlocking teeth and mirrored image teeth can be seen. The orientation of the teeth allow identical locking strands to be used in the binder. The locking strands are inserted through receiver hole 6 with the teeth 7 of the strand facing the row of receiver teeth 9 and then pushed into place as previously described. As can be seen the locking strands are slightly off center in the prepunched holes of the paper sheets and covers so that they may bypass each other in the receiver grooves 11 of the top receiver 15. Referring simultaneously to FIG. 7 and FIG. 8 it can be seen how the locking strand end is held in the locked position. FIG. 7 is a sectional view of the top receiver with the locking strand in place. Nipple 19 is engaged into locking slot 10, which is made possible by small deformations and deflections of side wall 18. Grooves 11 are generally formed of side walls 18, center wall 17, and bottom 12. FIG. 9 is a side view of the locking strand end detailing the release tab 13 and locking nipple 19. The release tab is ordinarily in a flat position, so it cannot be inadvertently lifted. Once lifted, it provides sufficient grip to pull the locking strand up and disengage nipple 19 from locking slot 10.

Accordingly, it can be seen that the interlocking strands and receiver increase the usability of a binder for binding sheets of paper. The components provide an easy and nondestructive means of assembling and disassembling a binder to add sheets of paper.

It is further seen that the present invention addresses and corrects many of the disadvantages of the currently produced binders. It provides a binder that is economically produced of suitable plastic materials, thereby increasing durability and usability of the binder. It further provides a binder that has a minimal number of simple components making the binder economical to produce and easy to use. For example, the locking strands are identical and simply installed in different orientations to be locked onto the top receiver. It further provides a binder that does not have thin sharp components that can cut the paper sheets or user's fingers. It provides a binder that is readily produced in a variety of colors, for the purpose of coding files or marketing considerations. In addition, one of the most important features of the present invention is that the binder automatically adjusts to the bound paper thickness and requires no interchange or adjustment of parts to accommodate various paper stack thicknesses. It does, however allow for interchanging of locking strands of different length to accommodate larger binder thicknesses. The present invention is suitable for use with binders of any number of prepunced holes. While the illustrated embodiment shows a two hole application, it may be used on any number of holes by simply providing a locking strand for each hole, and a groove with interlocking teeth for each strand.

Although the description above contains many specificities, these should not be construed as limiting the scope of the invention but as merely providing illustrations of some of the presently preferred embodiments of this invention. For example, where a certain number of teeth are shown in the illustrations, a smaller or larger number of teeth may be used, or the teeth may be shaped differently, while maintaining the locking feature. Though the receiving grooves are shown side by side in the top receiver, they may be in line and oriented in opposite directions from the sheet and binder holes. Also, even though the locking strands are shown with separate retaining plates at the base of the strand, the strands may actually be connected with an adjoining plate or strap.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

Thus the scope of the invention should be determined by the appended claims and their legal equivalents, rather than by the examples given.

We claim:

1. A paper binding device for fastening one or more sheets comprising:

an elongated flexible strand with a plurality of locking elements evenly spaced along the length of said strand and, attached to said strand, a flanged backing base at one end, a tab and an engaging element at the opposing end of said strand;

a receiving member having a plurality of elongated filisters oriented side by side and extending a distance generally longitudinal, the length of said receiving member, said filisters being of size and shape to receive above said strand, said strand being movable between a locked and released position relative to said filisters;

a plurality of apertures, passing through said receiving member and into said elongated filisters and being spaced apart a distance to receive above said strand;

a groove in one or more walls of said elongated filisters positioned to receive said engaging elements of said strand when said strand is in locked position in said filister;

a plurality of locking elements compatible to engage the locking elements spaced along the length of above said strand, evenly spaced along the interior of above said elongated filisters and of a shape and position to engage said locking elements on said strand, said locking elements of said strand and said elongated filister being engaged and interlocked when said strand is in position in elongated void, and said locking elements of a shape to nondestructively disengage when said strand end is lifted and rotated from said filister by means of said tab and the strand is pulled in a generally upward direction, and said locking elements on said strand and in said filister allow said strand to be locked in said filister in numerous positions relative to said filister.

2. A paper binding device as in claim 1, in which said tab on said strand normally lies generally parallel to and against said strand length and which can be lifted to pull the said strand from the said filister.

3. A paper binding device as in claim 1, in which said tab extends in a direction generally normal to the side of said strand.

4. A paper binding device for fastening one or more sheets comprising:

a base;

a plurality of elongated flexible strands with a plurality of locking elements evenly spaced along the length of said strands, the strands extending from the base at a distance apart, and attached to said strands at the opposite end of said strands, a tab and an engaging element;

a receiving member having a plurality of elongated filisters oriented side by side and extending a distance generally longitudinal, the length of said receiving member, said filisters being of size and shape to receive above said strand, said strand being movable between a locked and released position relative to said filisters;

a plurality of apertures, passing through said receiving member and into said elongated filisters and being spaced apart the same distance as the respective strands on the base, the apertures providing passages through the receiving member and into said filisters for the respective strands;

a groove in one or more walls of said elongated filisters positioned to receive said engaging elements of said strand when said strand is in locked position in said filister;

a plurality of locking elements compatible to engage the locking elements spaced along the length of above said strand, evenly spaced along the interior of above said elongated filisters and of a shape and position to engage said locking elements on said strand, said locking elements of said strand and said elongated filister being engaged and interlocked when said strand is in position in elongated void, and said locking elements of a shape to nondestructively disengage when said strand end is lifted and rotated from said filister by means of said tab and the strand is pulled in a generally upward direction, and said locking elements on said strand and in said filister allow said strand to be locked in said filister in numerous positions relative to said filister.

5. A paper binding device as in claim 4, in which said tab on said strand normally lies generally parallel to and against said strand length and which can be lifted to pull the said strand from the said filister.

6. A paper binding device as in claim 4, in which said tab extends in a direction generally normal to the side of said strand.

7. A paper binding device as in claim 4, in which said receiving member and said base is integrally formed with a cover of the same material.

8. A paper binding device as in claim 4, in which said receiving member and said base is integrally formed of a cover of a different material.

* * * * *